US005617947A

United States Patent [19]

Momjian et al.

[11] Patent Number: 5,617,947

[45] Date of Patent: Apr. 8, 1997

[54] FOLDABLE STIFF METAL CHAIN NECKLACE AND BRACELET

[76] Inventors: Tsolag Momjian; Hagop Momjian, both of P.O. Box 19379, 91193 Jerusalem, Israel

[21] Appl. No.: 349,312

[22] Filed: Dec. 5, 1994

Related U.S. Application Data

[63] Continuation-in-part of Ser. No. 204,643, Mar. 1, 1994, Pat. No. 5,475,989.

[51] Int. Cl.[6] ..... A45C 11/04

[52] U.S. Cl. ..... 206/6.1; 206/566

[58] Field of Search ..... 206/6.1, 446, 306, 206/566; 220/4.23, 662, 665

[56] References Cited

U.S. PATENT DOCUMENTS

| | | | |
|---|---|---|---|
| 2,237,086 | 4/1941 | Bruns | 206/306 |
| 3,043,354 | 7/1962 | Fitzgerald | 220/4.23 |
| 3,378,136 | 4/1968 | Lubin | 206/6.1 |
| 3,876,065 | 4/1975 | Phelps | 206/6.1 |
| 4,061,226 | 12/1977 | Essen | 206/306 |
| 5,211,284 | 5/1993 | Parks | 206/6.1 |

FOREIGN PATENT DOCUMENTS

| | | | |
|---|---|---|---|
| 1269074 | 5/1990 | Canada | 206/6.1 |

*Primary Examiner*—David T. Fidei
*Attorney, Agent, or Firm*—James A. Quinton

[57] ABSTRACT

According to the invention, a crimp and crease resistant metal chain necklace and a container therefor are provided. The necklace is composed of adjoining rigid metal chain segments preferably a flat stiff metal chain such as herring-bone, serpentine or cobra chain made from a precious metal, preferably gold or silver. The ridged metal chain segments are of the type which are susceptible to crimping and creasing in ordinary usage and which cannot be folded without damaging the chain. The metal chain segments are interconnected by hinged connectors which are preferably integrally attached to such metal chain segments to provide a crimp and crease resistant chain which can be folded to a small size and preferably to about the length of the longest rigid metal chain segment. Preferably the hinged connector includes at least one rod about which the chain segments can pivot. Preferably the rod is concealed within the necklace to give a smooth, flat appearance.

4 Claims, 3 Drawing Sheets

FIG.1
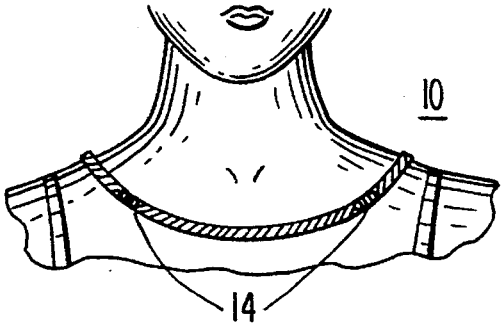
FIG.2
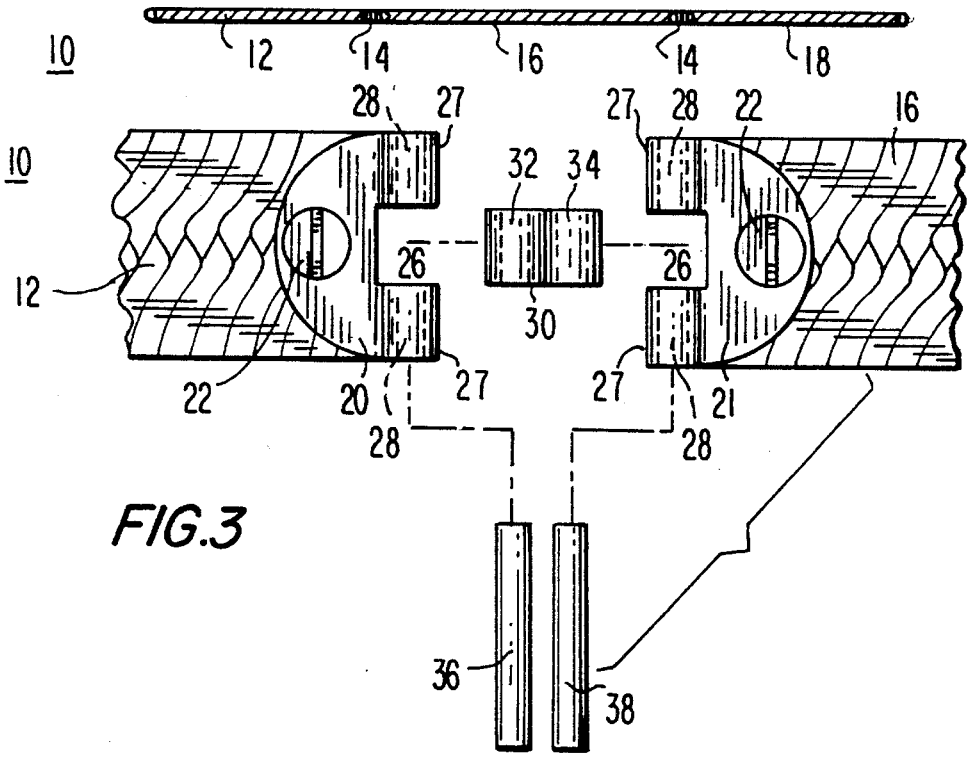
FIG.3
FIG.4
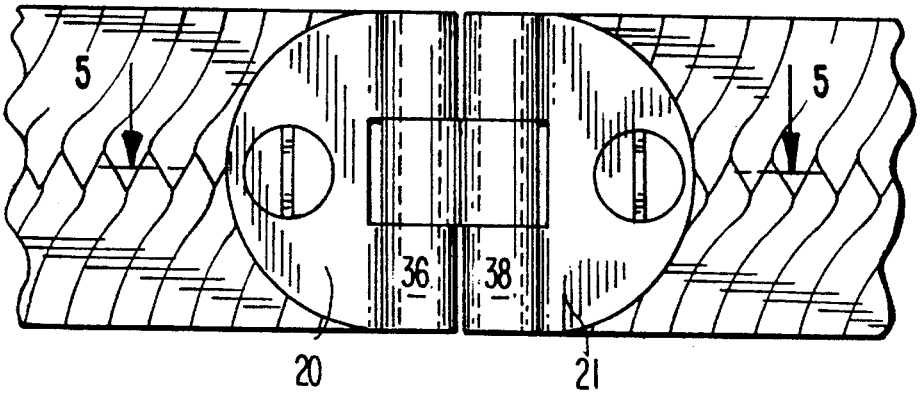

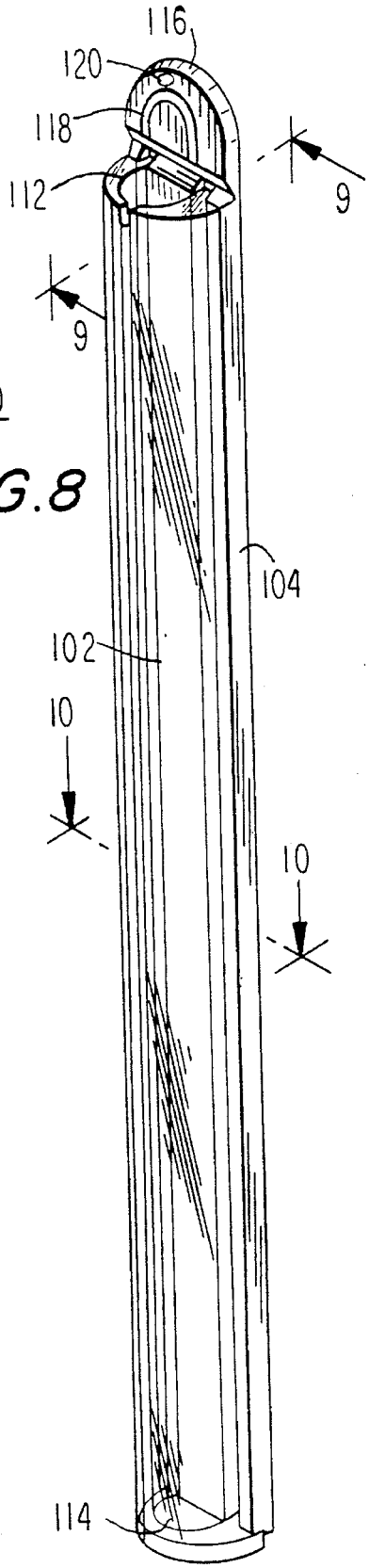
FIG.8
FIG.9
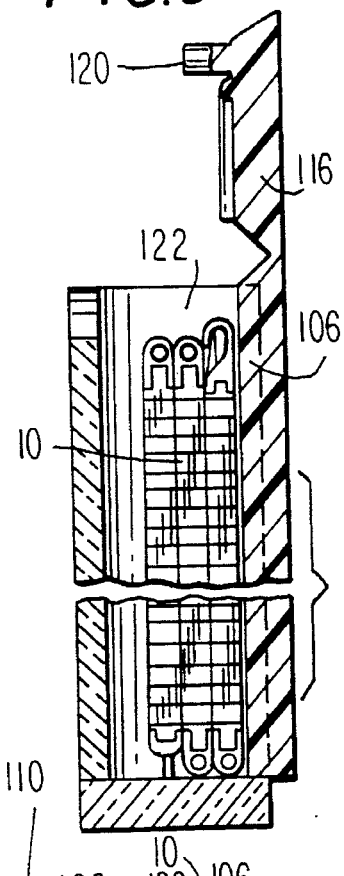
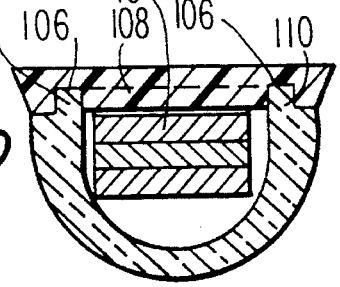
FIG.10
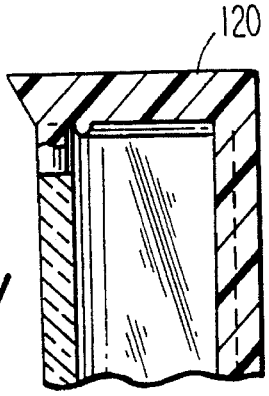
FIG.11

FOLDABLE STIFF METAL CHAIN NECKLACE AND BRACELET

This Application is a continuation-in-part of Ser. No. 08/204,643 filed Mar. 1, 1994, now U.S. Pat. No. 5,475,989.

BACKGROUND OF THE INVENTION

1. Field of the Invention

The present invention relates to stiff metal chain jewelry that can be unintentionally damaged due to permanent crimping or creasing in ordinary usage. In particular the invention relates to herringbone chains and containers for carrying the herringbone chains.

2. Description of the Prior Art

Flat metal chain jewelry particularly made of precious metals such as gold or silver is in widespread use. Such chain jewelry is often sold as necklaces or bracelets. Examples of such flat chain jewelry are herringbone, serpentine or cobra chains. These chains suffer from the disadvantage that they are stiff and inflexible. As a result, they are subject to permanent crimping, folding and or creasing during ordinary use and storage. Such necklaces can be permanently creased by merely folding the chain between two fingers.

Herringbone necklaces and bracelets are very popular. Generally herringbone chains are manufactured by taking a readily machine manufacturable link chain and subjecting it to hammering or pounding. The resulting chain is a thin, flat, stiff chain which can be permanently and irreversibly crimped, folded or creased during normal use or storage. Such chains have to be stored in long boxes so that the chains will not be crimped or creased. Moreover, in use, such chains are easily ruined by unintentional bending.

Connectors for jewelry are known in the prior art. Such connectors have been used to connect a jewelry element to a chain. See U.S. Pat. No. 5,148,689 (Azrielant). Also chain link jewelry is also known. See U.S. Pat. No. 1,102,645 (Cockshaw).

SUMMARY OF THE INVENTION

According to the invention a rigid or semi-rigid stiff metal chain preferably a herringbone chain for use as a necklace or as a bracelet is provided which has interspersed with the rigid or semi-rigid metal chain, one or more flexible connectors preferably two or more hinged connectors mounted to the stiff metal chain. Desirably the connectors will pivot around a pin and allow the chain to be easily folded preferably flat folded without permanently deforming or creasing the chain.

According to the invention a necklace or bracelet made from rigid or semi-rigid stiff flat metal chain is provided which is resistant to crimping and which can be folded for placement in a small container without creasing or crimping the metal chain. In another aspect of the invention a herringbone chain necklace is provided preferably having at least three herringbone chain segments which have been interconnected together by at least two hinged connectors integrally attached to the chain segments to provide an attractive flat continuous unitary necklace. The resulting necklace is resistant to crimping and creasing in ordinary use or storage.

According to the invention a stiff metal chain preferably a flat metal chain necklace such as herringbone, serpentine or cobra chain is provided by joining together three or more segments of the flat metal chain preferably gold herringbone with two or more hinged connectors. The flat metal chain segments and the connectors then form an integral flat unitary necklace. According to the invention the necklace can be folded along the hinged connectors so that it will be less likely to be crimped or creased during use and less likely to kink. In addition, the necklace can be folded at the connectors and placed in a small box which has a length of about the length of the longest segment.

In another aspect of the invention a flat stiff chain bracelet such as herringbone, serpentine or cobra, preferably gold herringbone is provided. At least one hinged connector is provided along the bracelet. As a result a crimp and crease resistant bracelet is provided.

In another aspect of the invention, a boxed piece of jewelry is provided. A stiff metal chain bracelet or necklace as described above is boxed in a compact protective container. The container is approximately as long as the longest segment of the flat folded chain and has an interior space for the chain which is slightly wider than the folded chain. According to the invention a compact protective container is provided for receipt of a stiff metal chain when it has been flat folded. The container is composed of an elongated tubular upper wall extending the length of the container. A flat bottom which extends the length of the container is interconnected with the tubular upper wall to complete the container. A long narrow interior space is thus formed between the tubular upper wall and the flat bottom. This space is adapted for snug receipt of the flat folded chain. The long narrow interior space has a length approximately equal to the length of longest metal chain segment and a width 1 to 2 times the width of said folded chain. An opening is provided at one end to allow receipt of said flat folded chain within said long narrow interior space.

It is an object to the invention to provide a necklace made out of rigid or semi-rigid stiff flat metal chain which nevertheless can be folded without damaging the chain.

It is an object of the invention to provide a chain necklace made of a rigid or semi-rigid metal chain segments which can be folded and carried in a small jewelry box without damaging the necklace.

It is an object of the invention to provide a necklace made from rigid or semi-rigid stiff chain which is resistant to damage from unintended crimping, folding, bending or creasing.

It is an object of the invention to provide a herringbone necklace which is resistant to crimping and permanent creasing in normal use.

It is an object of the invention to provide a herringbone necklace that can be carried in a box which is less than one-half the length of the chain.

It is an object of the invention to provided a compact protective carrying case for a stiff flat metal chain necklace or bracelet.

Other further objects will become evident by referring to the appended specifications and drawings.

The preferred embodiment of the present invention is illustrated in the drawings and examples. However, it should be expressly understood that the present invention should not be limited solely to the illustrative embodiment.

DESCRIPTION OF THE DRAWINGS

FIG. 1 is a perspective view of the chain necklace according to the invention in use.

FIG. 2 is a top view of the chain according to the invention.

FIG. 3 is an exploded partial top view of the chain according to the invention with the hinged connector disengaged.

FIG. 4 is a partial top view of the chain according to the invention with the hinged connector engaged.

FIG. 8 is a perspective view of compact container according to the invention for carrying the folded stiff metal chain jewelry.

FIG. 9 is a partial sectional view through 9—9 of FIG. 1.

FIG. 10 is a sectional view through 10—10 of FIG. 8.

FIG. 11 is a sectional view similar to FIG. 9 only with the cap and the closed position.

DETAILED DESCRIPTION OF THE INVENTION

Figure 5:
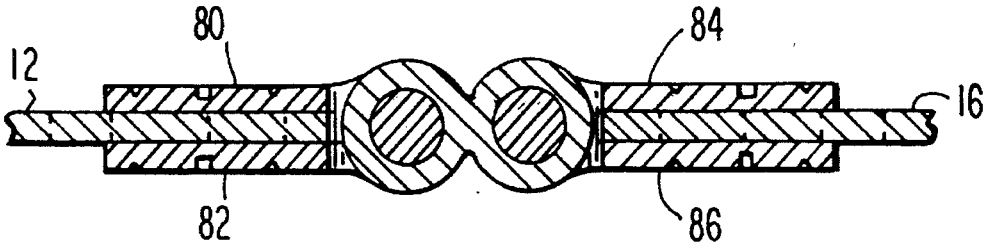
FIG. 5 is a cross section of FIG. 4 through 4—4.

According to the invention, a crimp and crease resistant metal chain necklace is provided which is composed of adjoining rigid metal chain segments, preferably two or more. The chain is preferably a flat stiff metal chain such as herringbone, serpentine or cobra chain made from a precious metal, preferably gold or silver. The ridged metal chain segments are of the type which are susceptible to crimping and creasing in ordinary usage and which cannot be folded without damaging the chain. The metal chain segments are interconnected by a hinged connector, preferably two hinged connectors which are preferably integrally attached to such metal chain segments to provide a crimp and crease resistant chain which can be folded to a small size. Preferably the chain can be flat folded to about the length of the longest rigid metal chain segment. Desirably the hinged connector includes at least one rod about which the chain segments can pivot. Preferably the rod is concealed within the necklace to give a smooth, flat appearance.

In another aspect of the invention, a boxed piece of jewelry is provided. A stiff metal chain bracelet or necklace as described above is boxed in a compact protective container. The container is approximately as long as the longest segment of the flat folded chain and has an interior space for the chain which is slightly wider than the chain. According to the invention a compact protective container is provided for receipt of a chain when it has been flat folded. Desirably the boxed chain jewelry is about ⅓ as long as the unfolded metal chain jewelry itself and hence, a compact package is provided. Optionally if there are more than three segments, the boxed chain jewelry can be less than ⅓ the length of the unfolded jewelry. The container is composed of an elongated tubular upper wall extending the length of the container. A flat bottom which extends the length of the container is interconnected with the tubular upper wall to complete the container. A long narrow interior space is thus formed between the tubular upper wall and the flat bottom. This space is adapted for snug receipt of the flat folded chain. The long narrow interior space has a length approximately equal to the length of longest metal chain segment and a width 1 to 2 times the width of said folded chain. An opening is provided at one end to allow receipt of said flat folded chain within said long narrow interior space. Preferably the height of the container is such that the tubular upper wall will bear against the chain to prevent excessive shifting of the chain.

Referring now to the drawings, as shown in FIGS. 1 and 2 a crease and crimp resistant metal jewelry chain necklace preferably a gold herringbone necklace 10 is provided. As best seen in FIG. 2 the necklace 10 is composed of a plurality of stiff flat metal chain segments 12, 16 and 18. The chain is composed of at least two segments. Preferably at least three (3) chain segments are used. Stiff flat metal chain elements 12, 16 and 18 are preferably a herringbone, serpentine or cobra chain most preferably herringbone chain made from a precious metal such as gold or silver, most preferably gold. The stiff metal chain segments are connected to one another through a hinged connector preferably two or more hinged connectors 14.

As best seen in FIG. 3, hinged connectors 14 preferably are composed of opposed U-shaped keepers 20 and 21 and coupling 30. The U-shaped keepers 20 and 21 are mounted to adjoining chain segments 12, 16 and 18 at each adjoining end. Referring to FIG. 3, segment 16 and segment 12 are shown to have the opposed keepers 20 and 21 mounted to the opposed ends of segments 12 and 16. Preferably the connectors 14 are gold or gold plated so that they blend with the herringbone chain, although optionally they can be made to provide a contrasting appearance, e.g., white gold or silver connectors. Each U-shaped keeper has a tubular channel 28 through legs 27 for receipt of tubular rods 36 and 38. A coupling 30 having tubular channels 32 and 34 is provided for fitting into the hollow 26 in U-shaped keeper 20 and 21. Coupling 30 is mounted into hollow 26 in each opposed U-shaped keeper 20 and 21 so that channel 32 aligns with tubular channel 28 in U-shaped keeper 20 and tubular channel 34 aligns with tubular channel 28 in keeper 21. Rods 36 and 38 are provided for pivotly connecting the keepers 20 and 21. Rod 36 is mounted into the keeper 20 through aligned tubular channels 28 and 32. Rod 38 is mounted into keeper 21 aligned channels 28 and 34 to provide for a hinged connection between the keepers 20 and 21. The channels 28 optionally are slightly crimped to retain the rods. U-shaped keeper 20 has a top plate 80 and an opposed identical bottom plate 82 spaced apart from said top plate 80 for receipt of an end of chain segment 12, 16 or 18. Keeper 21 is similarly constructed with top plate 84 and bottom plate 86. The keeper 20 is mounted to the end of chain 12 by sliding one end of the chain into the space between the top and bottom plates 80 and 82 and heat soldering the keeper to the chain. Keeper 21 is secured in the same manner to segment 16 between top and bottom plates 84 and 86. Optionally as shown in FIGS. 3 and 4, decorative screw heads 22 provided on the surface of keepers 20 and 21. However, as shown, they are only decorative. Optionally the keepers can be mounted to the chain in any secure manner such as screwing or riveting. As a result segments 12, 16 and 18 are Joined together in a hinged fashion. According to the invention the coupling rods 36 and 38 are attractively hidden in the tubular channels 28 and 32 and 34. As a result when the necklace has been assembled the hinge that is, the pivoting rods 36 and 38 are hidden from view and a smooth flat attractive chain necklace is provided. As shown in FIGS. 3 and 4 there are actually four (4) possible pivot points provided. Segment 12 can pivot around rod 36 and rotate independently of segment 16. Similarly segment 16 can rotate around rod 38 as the pivot point and rotate independently of segment 12. Coupling 30 also rotates about rod 36 and rod 38. As a result, a very flexible hinged connection is provided.

Figure 6:
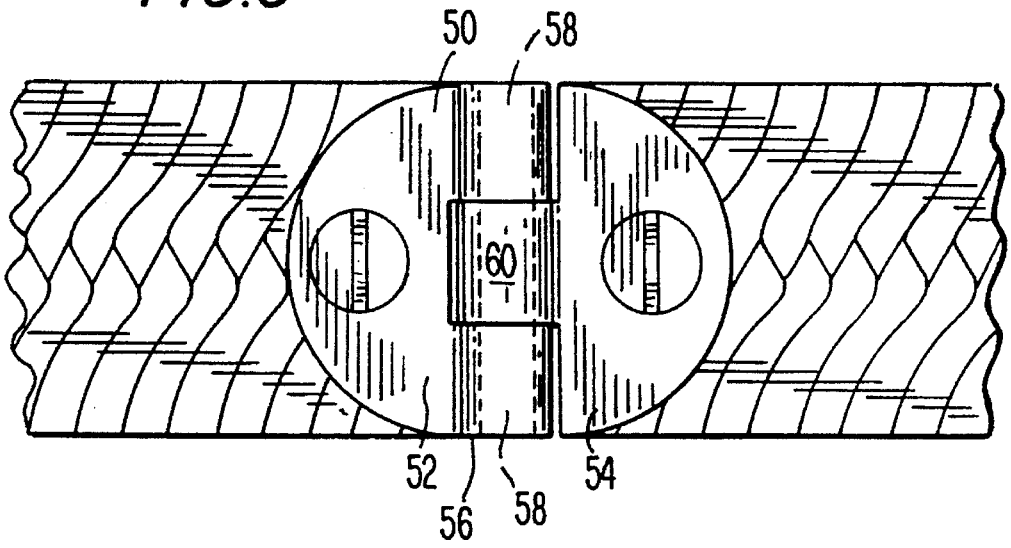
FIG. 6 is a top view of an alternate connector for use in the invention.
Figure 7:
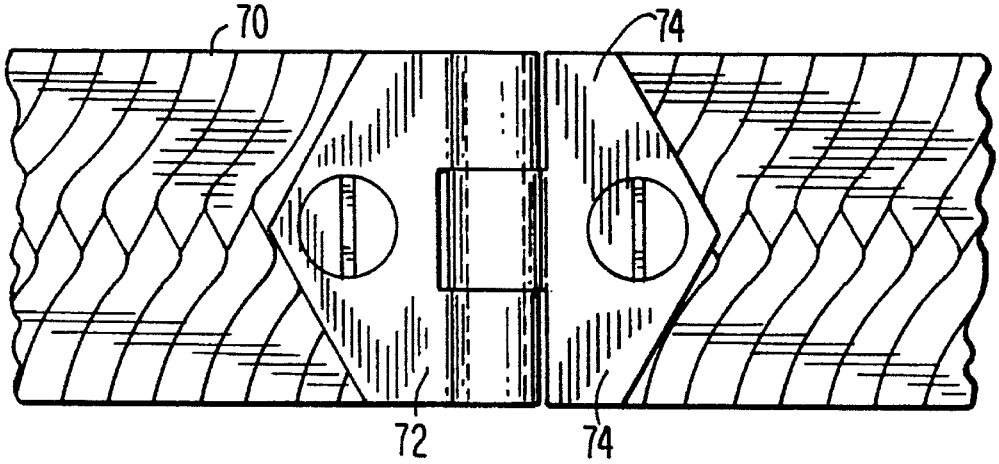
FIG. 7 is a top view of another alternate connector for use in the invention.

Alternately other types of connectors can be provided. As shown in FIG. 6, hinged connector 50 is provided with a U-shaped keeper 52 and an interconnecting member 54 having a projection 62 adapted to fit into the hollow of U-shaped keeper 52. A tubular opening 58 is provided through the legs of U-shaped connector 52. A tubular opening 60 is provided in the projection portion 56 of interconnecting member 54. Rod 58 is then mounted therein. As a result a hinged connection is provided with a single pivot point which conceals pivoting rod from view. FIG. 7 shows an alternate design where the keepers are of a slightly different shape. Thus, in FIG. 7 a connector 70 which is composed of a V-shaped keeper 72 and a mating projecting member 74 are provided. Otherwise the operation is the same as set forth for FIG. 6 with a resulting single hinge connection with a concealed coupling rod.

According to the invention, a necklace which is composed of a plurality of stiff metal segments which are susceptible to crimping and creasing in ordinary use are interconnected into a flat continuous necklace which is resistant to crimping and creasing and which can be folded to a small size is provided. Preferably the necklace can be folded to a size approximately the same as the largest segment of the necklace.

Alternatively a bracelet may be provided. Where a bracelet is provided two or more stiff metal segments are joined together through one or more hinged connectors. As a result the bracelet can be folded to the length of the longest segment. The resulting bracelet is resistant to damage from crimping or creasing.

In another aspect of the invention, a container is provided for the flat folded stiff metal chain jewelry. Referring to FIG. 8 through FIG. 11 an elongated container 100 is provided for receipt of a flat folded stiff metal chain jewelry 10 made according to the invention. The container 100 includes an elongated sloping tubular upper wall 102 preferably made of clear plastic, which extends the entire length of the container. A flat rectangular shaped bottom 104 is provided which in combination with sloping tubular upper wall 102 forms container 100. Preferably flat rectangular bottom 104 has grooves 106 adjacent each side of rectangular bottom 104. Container floor 108 is provided between grooves 106 and is desirably slightly larger than the width of the flat folded chain. Optionally the floor 108 can be up to about two times wider than the flat folded chain for which the container is designed.

The tubular upper wall 102 has projections 110 on either side which snugly fit into grooves 106 in the flat rectangular bottom 104. The tubular upper wall 102 can be mounted to the flat rectangular bottom 104 by any convenient method. For example, the projections 110 of sloping tubular upper wall 102 can be glued to the flat rectangular piece 104 when they are inserted into grooves 106 or optionally a snap fit can be provided. The resulting container 100 has a space between the sloping tubular upper wall 102 and the floor 108 for receiving the jewelry. A flat surface is provided for receipt of the flat folded chain. The height of the container should be sufficient so that the flat folding chain can be inserted easily into the container 100 and carried without rolling around in the container. In use, the sloping tubular upper wall 102 preferably bears against the chain to prevent it from rolling around.

An opening 112 preferably U-shaped is provided at one end (the proximate end) of the container 110 for insertion and removal of a flat folding chain 10. The distal end of the container 100 is permanently sealed closed by end piece 114 which is preferably integral with tubular upper wall 102. A cap 116 is provided to allow selective access to opening 112. When the chain has been placed into the container 100, the cap 116 can be closed. The jewelry can then be carried in the container without danger of unintentional discharge from the container. Preferably cap 116 is hingedly attached to rectangular bottom 104. Desirably cap 116 is U-shaped. Preferably a U-shaped projection 118 is provided for snug engagement with U-shaped opening 112 in container 100. Optionally a snap closure mechanism is provided whereby projection 120 is provided for snap engagement into slot 122 for secure engagement of cap 116 in the closed position. Other caps such as screw on caps or friction caps are contemplated according to the invention. A long narrow interior space 122 is formed between the tubular upper wall 102 and the flat bottom 104. This space 122 is adapted for receipt of the flat folded chain 10. The long narrow interior space 122 has a length approximately equal to the length of longest metal chain segment of jewelry 10 and a width 1 to 2 times the width of the said folded chain.

The resulting container 100 provides a secure carrying box for the flat folded chain. The clear plastic tubular upper wall 102 allows the user to visually check that the flat folding chain 10 is in place in the container. Additionally the container 100 provides a desirable display device for point of sale display of the flat folding chain 10. When the flat folding chain has been placed in the container, it is protected from inadvertent bending or the like. Moreover, since the container 100 is compact, it is easy to carry and allows the user to transport the flat folding chain without the danger of damage from unintended bending or the like. The protective plastic container 100 thus allows easy transportation of the flat folding chain in a small compact package.

The foregoing is considered as illustrative only to the principles of the invention. Further, since numerous changes and modifications will occur to those skilled in the art, it is not desired to limit the invention to the exact construction and operation shown and described above, and accordingly all suitable modifications and equivalents may be resorted to, falling within the scope of the invention.

We claim:

1. A boxed piece of jewelry comprising:

a. adjoining stiff metal chain segments that are susceptible to permanent crimping or creasing;

b. hinged connector means pivotly attaching each metal chain segment to the adjoining segment;

whereby said chain can be flat folded at each hinged connector to a length approximately equal to the length of the longest metal chain segment without crimping or creasing the jewelry;

c. a compact container for receipt of said chain when it has been flat folded, said container comprising:

i) an elongated tubular upper wall extending the length of the container; said tubular wall bearing against said flat folded chain to prevent movement of jewelry;

ii) a flat bottom extending the length of the interior of the container and interconnected with said tubular upper wall;

iii) a long narrow interior space formed between said tubular upper wall and said flat bottom adapted for receipt of the flat folded chain;

iv) said container having an opening at one end to allow receipt of said flat folded chain within said long narrow interior space;

v) means to selectively open and close said opening.

2. A boxed piece of jewelry according to claim 1 wherein said tubular upper wall is transparent.

3. A boxed piece of jewelry according to claim 1 wherein the jewelry is a necklace composed of at least three segments.

4. A boxed piece of jewelry according to claim 1 further comprising:

said long narrow interior space having a length approximately equal to the length of longest metal chain segment and a width 1 to 2 times the width of said folded chain.

* * * * *